US012258694B2

(12) United States Patent
Ogawa et al.

(10) Patent No.: US 12,258,694 B2
(45) Date of Patent: Mar. 25, 2025

(54) SEWING MACHINE

(71) Applicant: JUKI CORPORATION, Tokyo (JP)

(72) Inventors: Tatsuya Ogawa, Tokyo (JP); Kuniaki Sato, Tokyo (JP); Hajime Nakayama, Tokyo (JP); Juan Zhang, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,105

(22) Filed: Nov. 28, 2023

(65) Prior Publication Data

US 2024/0175181 A1 May 30, 2024

(30) Foreign Application Priority Data

Nov. 29, 2022 (JP) ..... 2022-190096

(51) Int. Cl.
*D05B 29/02* (2006.01)
*D05B 1/08* (2006.01)
(Continued)

(52) U.S. Cl.
CPC ..... *D05B 29/02* (2013.01); *D05B 1/08* (2013.01); *D05B 27/10* (2013.01); *D05B 47/04* (2013.01); *D05B 57/10* (2013.01)

(58) Field of Classification Search
CPC ..... D05B 29/02; D05B 27/10; D05B 27/14; D05B 27/16; D05B 1/08; D05B 47/04; D05B 57/10
See application file for complete search history.

(56) References Cited

U.S. PATENT DOCUMENTS 4,726,309 A * 2/1988 Popp ..... D05B 27/08 112/235
4,889,062 A * 12/1989 Orii ..... D05B 27/14 112/260
(Continued)

*Primary Examiner* — Nathan E Durham
(74) *Attorney, Agent, or Firm* — BAKERHOSTETLER

(57) ABSTRACT

A sewing machine that suppresses sewing defects is provided. The sewing machine includes: a sewing needing, held by a needle bar and moving back and forth while holding an upper thread: a shuttle, configured to hold a bobbin which is housed in a bobbin case and around which a lower thread is wound, and cooperating with the sewing needle to form a seam; a presser foot member, configured to press a to-be-sewn article at a sewing position directly below the sewing needle: a pressure adjustment portion, adjusting pressure applied to the to-be-sewn article by the presser foot member; a feeding mechanism, where endless feeding belts for feeding the to-be-sewn article from the sewing position to a first direction are disposed on two sides of a second direction orthogonal to a first direction with respect to the sewing position, the feeding mechanism is provided with a belt drive portion, and the belt drive portion independently drives the feeding belts on one side of the second direction with respect to the sewing position and the feeding belts on another side of the second direction with respect to the sewing position; and a control portion, configured to control the pressure adjustment portion to make a pressure of the presser foot member be corresponding to a difference between a feeding amount of the feeding belts on one side of the second direction with respect to the sewing position and a feeding amount of the feeding belts on another side of the second direction with respect to the sewing position.

5 Claims, 4 Drawing Sheets

(51) Int. Cl.

| | |
|---|---|
| ***D05B 27/10*** | (2006.01) |
| ***D05B 47/04*** | (2006.01) |
| ***D05B 57/10*** | (2006.01) |

(56) References Cited

U.S. PATENT DOCUMENTS

| | | | | |
|---|---|---|---|---|
| 5,551,361 | A * | 9/1996 | Clapp | D05B 29/02<br>112/475.01 |
| 6,415,727 | B1 * | 7/2002 | Burgess | D05B 27/10<br>112/152 |
| 6,564,732 | B1 * | 5/2003 | Hosagasi | D05B 29/02<br>310/154.06 |
| 2009/0301369 | A1 * | 12/2009 | Kawaguchi | D05B 69/10<br>112/235 |
| 2016/0177484 | A1 * | 6/2016 | Hayashida | D05B 29/02<br>112/141 |
| 2019/0292701 | A1 * | 9/2019 | Shiraishi | D05B 29/12 |

* cited by examiner

| | | | | | | | |
|---|---|---|---|---|---|---|---|
| Feeding belts 21A | 3 | 3 | 3 | 3 | 3 | 3 | 3 |
| Feeding belts 21B | 3 | 4 | 5 | 6 | 7 | 8 | 9 |
| Difference (mm) | 0 | 1 | 2 | 3 | 4 | 5 | 6 |
| Pressure | 100 | 90 | 80 | 70 | 60 | 50 | 40 |

FIG. 4

| | | | | | | | |
|---|---|---|---|---|---|---|---|
| Feeding belts 21A | 3 | 3 | 3 | 3 | 3 | 3 | 3 |
| Feeding belts 21B | 3 | 4 | 5 | 6 | 7 | 8 | 9 |
| Difference (mm) | 0 | 1 | 2 | 3 | 4 | 5 | 6 |
| Pressure | 50 | 60 | 70 | 80 | 90 | 100 | 110 |

FIG. 5

SEWING MACHINE

FIELD

The present disclosure relates to a sewing machine.

BACKGROUND

In a field of sewing machines, a sewing machine, called a straight-stitch sewing machine, is known as disclosed in Japanese Patent Application Publication No. 2017-184980.

SUMMARY

Problem to be Solved

In the above-mentioned sewing machine, by controlling a feeding direction at a sewing position directly below a sewing needle, a curved seam can be formed on a to-be-sewn article. In this case, if a pressure of a presser foot member that presses the to-be-sewn article is too high, sewing defects, such as pleats and fabric bending, may occur.

The present disclosure is made in view of the above circumstance, and aims to provide a sewing machine capable of suppressing sewing defects when a curved seam is formed on a to-be-sewn article.

Solution

The present disclosure provides a sewing machine, including: a sewing needing, held by a needle bar, and moving back and forth while holding an upper thread: a shuttle, configured to hold a bobbin around which a lower thread is wound and which is housed in a bobbin case, and cooperating with the sewing needle to form a seam; a presser foot member, configured to press a to-be-sewn article at a sewing position directly below the sewing needle: a pressure adjustment portion, adjusting pressure applied to the to-be-sewn article by the presser foot member: a feeding mechanism, where endless feeding belts for feeding the to-be-sewn article from the sewing position to a first direction are disposed on two sides of a second direction orthogonal to a first direction with respect to the sewing position, the feeding mechanism is provided with a belt drive portion, and the belt drive portion independently drives the feeding belts on one side of the second direction with respect to the sewing position and the feeding belts on another side of the second direction with respect to the sewing position: and a control portion, configured to control the pressure adjustment portion to make a pressure of the presser foot member be corresponding to a difference between a feeding amount of the feeding belts on one side of the second direction with respect to the sewing position and a feeding amount of the feeding belts on another side of the second direction with respect to the sewing position.

Beneficial Effects

According to the present disclosure, sewing defects can be suppressed when a curved seam is formed on a to-be-sewn article.

BRIEF DESCRIPTION OF THE DRAWINGS

FIG. 4 is a diagram showing an example of a relationship between a difference in a feeding amount of feeding belts and a pressure of a presser foot member according to an embodiment:

FIG. 5 is a diagram showing an example of a relationship between a difference in a feeding amount of feeding belts and a tension of an upper thread.

REFERENCE NUMERALS

LT: lower thread: PS: sewing position: S: to-be-sewn article; Sb: back surface: SE: seam; UT: upper thread: 1: sewing machine: 2: sewing machine head: 3: sewing needle: 4: needle bar; 5: thread take-up lever: 6: thread adjuster: 7: throat plate; 8: presser foot member: 9: shuttle; 10: 23A and 23B: motor: 11: feeding mechanism: 13 and 30: control portion: 21: 21A and 21B: feeding belt; 22: belt drive portion; 22A and 22B: drive line; 24A and 24B: sprocket: 31: processing portion: 32: storage portion: 33: needle drive control portion; 34: belt drive control portion: 35: computing portion; 37: tension control portion.

DETAILED DESCRIPTION

Hereinafter, embodiments according to the present disclosure will be described based on the drawings. In addition, the present disclosure is not limited to the embodiments. The structural elements of the following embodiments include modes that can be replaced and easily implemented by those skilled in the art, or modes that are substantially the same.

A sewing machine 1 according to this embodiment will be described. In this embodiment, positional relationships of each part is explained based on a local coordinate system defined in the sewing machine 1. The local coordinate system is defined using a XYZ orthogonal coordinate system. A direction parallel to an X-axis in a predetermined plane is set as an X-axis direction (second direction). A direction parallel to a Y-axis in the predetermined plane orthogonal to the X-axis is set as a Y-axis direction (first direction). A direction parallel to a Z-axis orthogonal to the predetermined plane is set as a Z-axis direction. A rotation direction centered on the X-axis is set as a OX direction.

Figure 1:
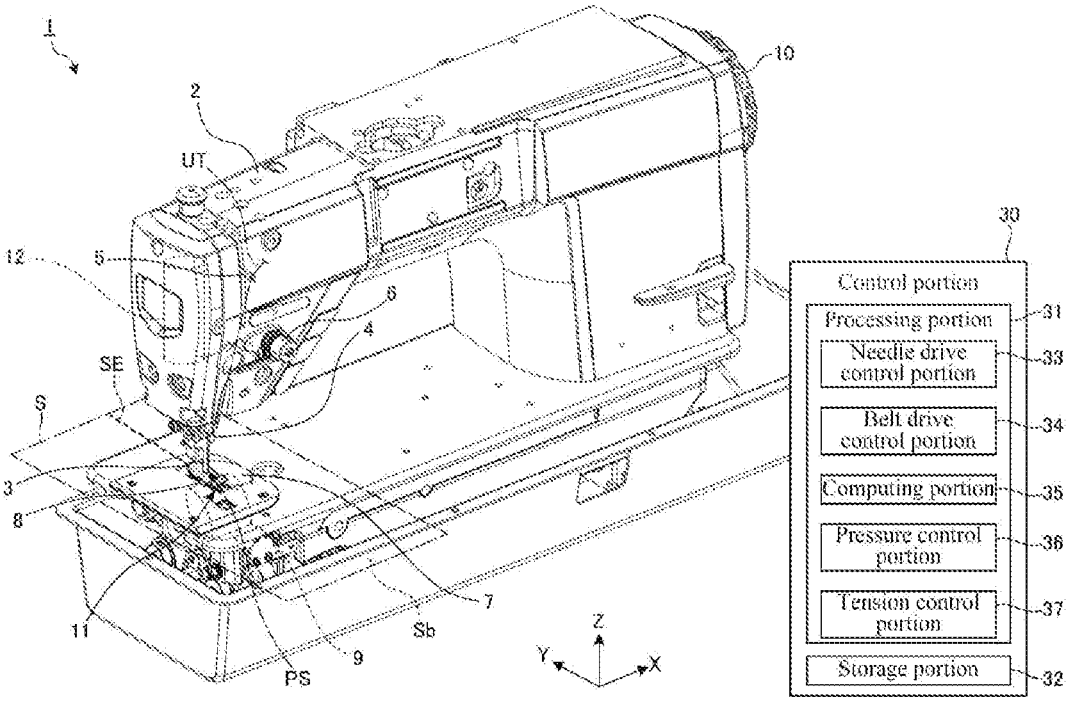
FIG. 1 is a perspective view schematically showing a sewing machine according to an embodiment.

FIG. 1 is a perspective view schematically showing a sewing machine 1 according to an embodiment. As shown in FIG. 1, the sewing machine 1 includes: a sewing machine head 2, a needle bar 4, a thread take-up lever 5, a thread adjuster 6, a throat plate 7, a presser foot member 8, a shuttle 9, a motor 10, a feeding mechanism 11, a pressure adjustment portion 12 and a control portion 30.

The needle bar 4 holds a sewing needle 3 to move back and forth in the Z-axis direction. The needle bar 4 holds the sewing needle 3 in a manner that the sewing needle 3 is parallel to the Z-axis. The needle bar 4 is supported by the sewing machine head 2. The needle bar 4 is provided above the throat plate 7 and can face a surface of a to-be-sewn article S. An upper thread UT is hung on the sewing needle 3. The sewing needle 3 includes a threading hole through which the upper thread UT passes. The sewing needle 3 keeps the upper thread UT on an inner surface of the threading hole. Since the needle bar 4 moves back and forth in the Z-axis direction, the sewing needle 3 moves back and forth in the Z-axis direction while holding the upper thread UT.

The thread take-up lever 5 supplies the upper thread UT to the sewing needle 3. The thread take-up lever 5 is supported by the sewing machine head 2. The thread take-up lever 5 includes a thread take-up lever hole through which the upper thread UT passes through. The thread take-up lever 5 holds the upper thread UT on an inner surface of the thread take-up lever hole. The thread take-up lever 5 moves back and forth in the Z-axis direction while holding the upper thread UT. The thread take-up lever 5 moves back and forth in conjunction with the needle bar 4. The thread take-up lever 5 feeds out the upper thread UT or pulls up the upper thread UT by moving back and forth in the Z-axis direction.

The thread adjuster 6 (upper thread tension adjustment structure) applies tension to the upper thread UT. The upper thread UT is supplied to the thread adjuster 6 from a thread supply source. In a path through which the upper thread UT passes, the thread take-up lever 5 is provided between the sewing needle 3 and the thread adjuster 6. The thread adjuster 6 adjusts the tension of the upper thread UT supplied to the sewing needle 3 through the thread take-up lever 5.

The throat plate 7 supports the to-be-sewn article S. The sewing needle 3 held by the needle bar 4 faces the throat plate 7. The throat plate 7 includes a needle hole through which the sewing needle 3 passes. The sewing needle 3 that penetrates the to-be-sewn article S supported by the throat plate 7 passes through the needle hole.

The presser foot member 8 presses the to-be-sewn article S from above. The presser foot member 8 is supported by the sewing machine head 2. The presser foot member 8 is provided above the throat plate 7, and the to-be-sewn article S is held between the presser foot member 8 and the throat plate 7.

The shuttle 9 holds a bobbin housed in a bobbin case. The shuttle 9 is provided below the throat plate 7. The shuttle 9 rotates in the OX direction. The shuttle 9 rotates in conjunction with the needle bar 4. The shuttle 9 supplies a lower thread LT. The shuttle 9 penetrates the to-be-sewn article S supported by the throat plate 7, and pulls up the upper thread UT from the sewing needle 3 that passes through the needle hole of the throat plate 7.

The motor 10 generates power. The motor includes: a stator supported by the sewing machine head 2 and a rotor rotatably supported by the stator. The motor 10 generates power by rotating the rotor. The power generated by the motor 10 is transmitted to the needle bar 4, the thread take-up lever 5 and the shuttle 9 respectively through a power transmission mechanism (not shown). The needle bar 4, the thread take-up lever 5 and the shuttle 9 are linked together. By transmitting the power generated by the motor 10 to the needle bar 4, the needle bar 4 and the sewing needle 3 held by the needle bar 4 move back and forth in the Z-axis direction. By transmitting the power generated by the motor 10 to the thread take-up lever 5, the thread take-up lever 5 moves back and forth in the Z-axis direction in conjunction with the needle bar 4. By transmitting the power generated by the motor 10 to the shuttle 9, the shuttle 9 rotates in the θX direction in conjunction with the needle bar 4 and the thread take-up lever 5. The sewing machine 1 sews the to-be-sewn article S through cooperation of the sewing needle 3 held by the needle bar 4 and the shuttle 9.

The feeding mechanism 11 feeds the to-be-sewn article S from a sewing position PS to the Y-axis direction. In this embodiment, the feeding mechanism 11 is provided below the to-be-sewn article S provided at the sewing position PS. In addition, another feeding mechanism may also be provided above the article S provided at the sewing position PS. The feeding mechanism 11 includes feeding belts 21 and a belt drive portion 22.

Figure 2:
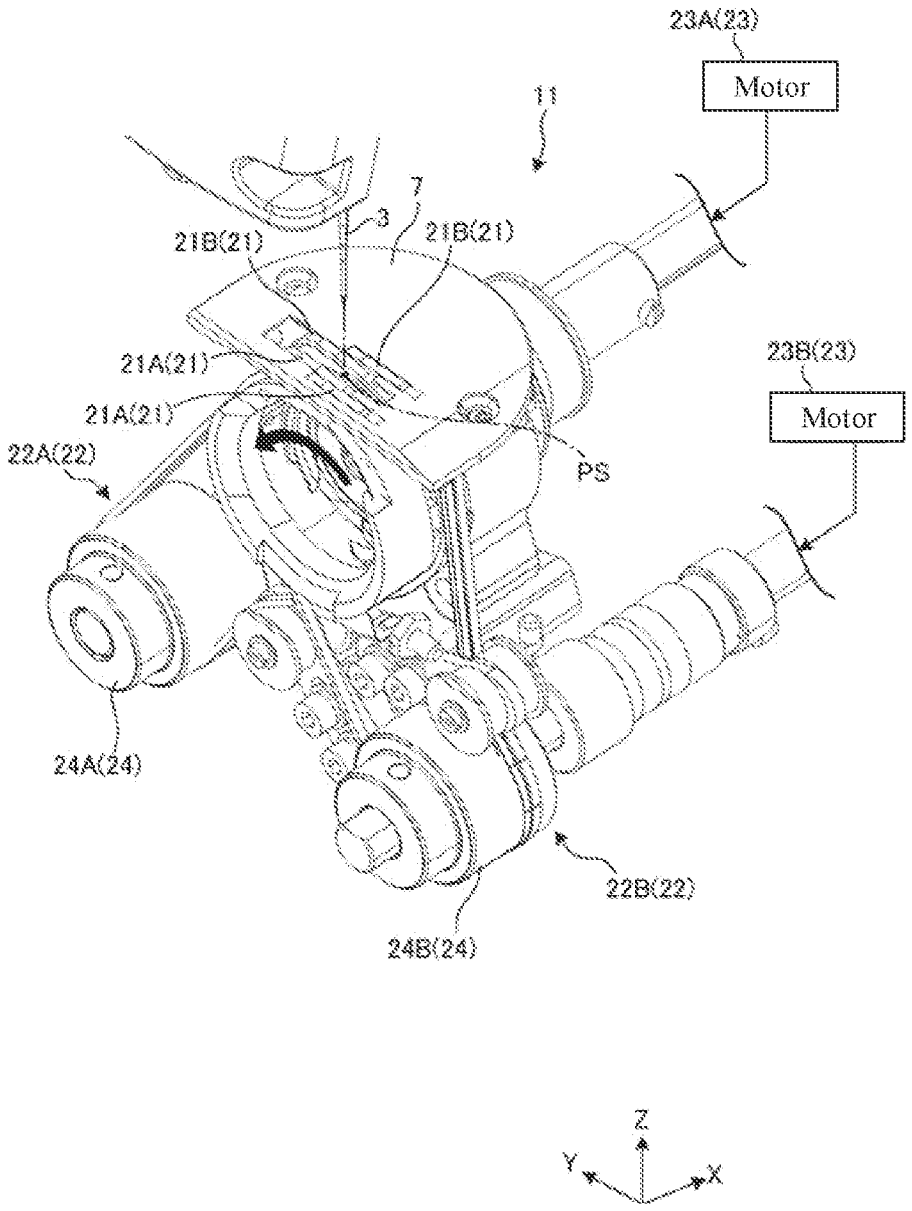
FIG. 2 is a diagram showing a feeding mechanism according to an embodiment.

FIG. 2 is a diagram showing a feeding mechanism 11 according to an embodiment. As shown in FIG. 2, the feeding belts 21 are in contact with a back surface Sb of the to-be-sewn article S. The feeding belts 21 are endless. The feeding belts 21 are provided on two sides in the X-axis direction with respect to the sewing position PS. Two feeding belts 21 are provided on two sides in the X-axis direction with respect to the sewing position PS, and a total of four feeding belts 21 are provided. Hereinafter, the two feeding belts 21 provided on one side (−X side) in the X-axis direction with respect to the sewing position PS are denoted as feeding belts 21A, and the two feeding belts 21 provided on another side (+X side) in the X-axis direction with respect to the sewing position PS are denoted as feeding belts 21B.

The belt drive portion 22 independently drives the feeding belts 21A on the −X side with respect to the sewing position PS and the feeding belts 21B on the +X side with respect to the sewing position PS. The belt drive portion 22 includes a drive line 22A that drives the feeding belts 21A on the −X side of the sewing position PS, and a drive line 22B that drives the feeding belts 21B on the +X side of the sewing position PS. The drive line 22A includes a motor 23A and a sprocket 24A. The drive line 22B includes a motor 23B and a sprocket 24B.

When the motor 23A and the motor 23B operate, the feeding belts 21A supported by the sprocket 24A and the feeding belts 21B supported by the sprocket 24B rotate to the OX direction. The to-be-sewn article S is fed in the Y-axis direction by a rotation of the feeding belts 21A and the feeding belts 21B.

In FIG. 1, the pressure adjustment portion 12 adjusts a pressure of the presser foot member 8 on the to-be-sewn article S. In an embodiment, the pressure adjustment portion 12 is provided inside the sewing machine head 2. The pressure adjustment portion 12 includes a drive source (not shown) such as a motor and so on, and a transmission mechanism that transmits a power of the drive source to the presser foot member 8.

The control portion 30 centrally controls an operation of the sewing machine 1. The control portion 30 includes a processing portion 31 and a storage portion 32. The processing portion 31 performs various information processing. The processing portion 31 includes a processor such as a central processing unit (CPU), and a memory such as a read only memory (ROM) and a random access memory (RAM).

The processing portion 31 includes: a needle drive control portion 33, a belt drive control portion 34, a computing portion 35, a pressure control portion 36 and a tension control portion 37.

The needle drive control portion 33 controls a movement of the sewing needle 3 in the Z-axis direction by controlling a rotation of the motor 10.

The belt drive control portion 34 controls a feeding amount of the feeding belts 21A and a feeding amount of the feeding belts 21B by controlling a rotation of the motor 23A of the belt drive portion 22 and a rotation of the motor 23B of the belt drive portion 22. When the feeding amount of the feeding belts 21A is the same as the feeding amount of the feeding belts 21B, a seam SE formed on the to-be-sewn article S is linear. When the feeding amount of the feeding belts 21A is greater than the feeding amount of the feeding belts 21B, the seam SE formed on the to-be-sewn article S is bent to the +X side. When the feeding amount of the feeding belts 21A is less than the feeding amount of the feeding belts 21B, the seam SE formed on the to-be-sewn article S is bent to the −X side. The greater the difference between the feeding amount of the feeding belts 21A and the feeding amount of the feeding belts 21B, the greater the curvature of the seam SE.

The computing portion 35 performs various computing. The computing portion 35 computes, for example, the difference between the feeding amount of the feeding belts 21A and the feeding amount of the feeding belts 21B.

The pressure control portion 36 controls the pressure adjustment portion 12 to make a pressure of the presser foot member 8 be corresponding to a difference between the feeding amount of the feeding belts 21A and the feeding amount of the feeding belts 21B. In an embodiment, the pressure adjustment portion 12 is adjusted to make the greater the difference between the feeding amount of the feeding belts 21A and the feeding amount of the feeding belts 21B, the less the pressure of the presser foot member 8.

The tension control portion 37 controls the thread adjuster 6 to make a tension of the upper thread UT be corresponding to the difference between the feeding amount of the feeding belts 21A and the feeding amount of the feeding belts 21B. In an embodiment, the thread adjuster 6 is adjusted to make the greater the difference between the feeding amount of the feeding belts 21A and the feeding amount of the feeding belts 21B, the greater the tension of the upper thread UT.

The storage portion 32 stores information such as various programs and data. The storage portion 32 includes storage apparatuses such as hard disk drive (HDD) and solid state drive (SSD).

In the control portion 30, the processor reads out various programs in the processing portion 31 and unrolls the various programs into the memory, and executes information processing corresponding to functions of the above-mentioned portions. Examples of various programs include programs stored in the storage portion 32, programs stored in an external storage medium, and the like. The control portion 30 functions as an information processing apparatus (computer) that performs various information processing. Furthermore, various programs may be executed by other information processing apparatuses different from the control portion 13, or various programs may be executed by the control portion 30 in cooperation with other information processing apparatuses.

The operation of the sewing machine 1 configured as above is described in the following. An operator arranges the to-be-sewn article S at the sewing position PS and makes the to-be-sewn article S to be a state of being pressed by the presser foot member 8. In this state, when the operator starts a sewing operation, the needle drive control portion 33 of the control portion 30 controls the rotation of the motor 10 so that the sewing needle 3 moves back and forth in the Z-axis direction. In addition, the belt drive control portion 34 controls the feeding amount of the feeding belts 21A and the feeding amount of the feeding belts 21B by controlling the motor 23A of the belt drive portion 22 and the motor 23B of the belt drive portion 22.

When the seam SE formed on the to-be-sewn article S is linear, the belt drive control portion 34 controls in a manner that the feeding amount of the feeding belts 21A is the same as the feeding amount of the feeding belts 21B; when the seam SE formed on the to-be-sewn article S is bent to the +X side, the belt drive control portion 34 controls in a manner that the feeding amount of the feeding belts 21A is greater than the feeding amount of the feeding belts 21B: and when the seam SE formed on the to-be-sewn article S is bent to the −X side, the belt drive control portion 34 controls in a manner that the feeding amount of the feeding belts 21A is less than the feeding amount of the feeding belts 21B.

Figure 3:
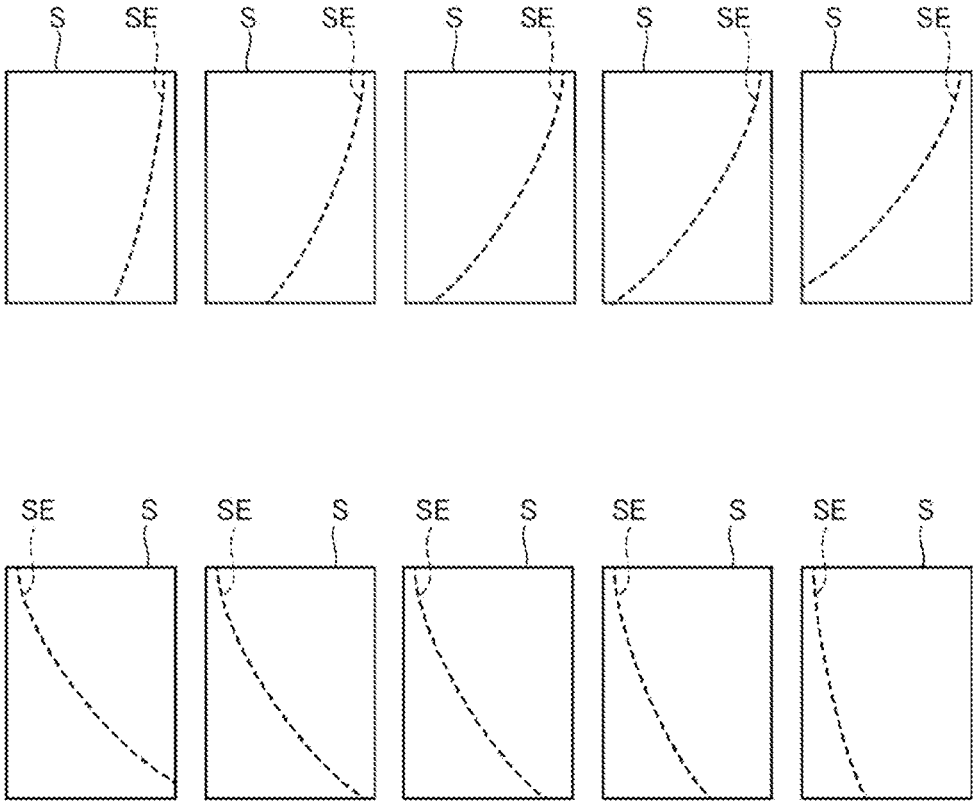
FIG. 3 is a diagram showing an example of a relationship between a difference in a feeding amount of feeding belts and curvature of a seam formed on a to-be-sewn article according to an embodiment.

FIG. 3 is a diagram showing an example of a relationship between a difference in a feeding amount of feeding belts 21 and curvature of a seam formed on a to-be-sewn article S according to an embodiment. The upper part of FIG. 3 shows an example that the feeding amount of the feeding belts 21A is constant (for example, the feeding amount per unit time is 1 mm) and the feeding amount of the feeding belts 21B is increased from the left side to the right side of the figure. In addition, the lower part of FIG. 3 shows an example that the feeding amount of the feeding belts 21B is constant (for example, the feeding amount per unit time is 1 mm) and the feeding amount of the feeding belts 21A is increased from the right side to the left side of the figure. As shown in FIG. 3, the greater the difference between the feeding amount of the feeding belts 21A and the feeding amount of the feeding belts 21B, the greater the curvature of the seam SE.

When a curved seam SE is formed on the to-be-sewn article S, the pressure of the presser foot member 8 applies the to-be-sewn article S. If the pressure of the presser foot member 8 is too large, the seam SE is not bent smoothly, and sewing defects such as pleats and fabric bending may occur. Therefore, in this embodiment, when the curved seam SE is formed on the to-be-sewn article S, the pressure of the presser foot member 8 is controlled to be not too large.

In an embodiment, when the feeding amount of the feeding belts 21A is different from the feeding amount of the feeding belts 21B, the computing portion 35 computes the difference between the feeding amount of the feeding belts 21A and the feeding amount of the feeding belts 21B.

The pressure control portion 36 controls the pressure of presser foot member 8 to be corresponding to a computed difference. For example, the pressure control portion 36 adjusts the pressure adjustment portion 12 to make the greater the difference between the feeding amount of the feeding belts 21A and the feeding amount of the feeding belts 21B, the less the pressure of the presser foot member 8.

FIG. 4 is a diagram showing an example of a relationship between a difference in a feeding amount of feeding belts 21 and pressure of a presser foot member 8 according to an embodiment. FIG. 4 shows an example that the feeding amount of the feeding belts 21A is constant (for example, the feeding amount per unit time is 3 mm) and the feeding amount of the feeding belts 21B changes. As shown in FIG. 4, the pressure of the presser foot member 8 is set to decrease as the difference between the feeding amount of the feeding belts 21A and the feeding amount of the feeding belts 21B increases. Setting information shown in FIG. 4 can be stored, for example, in the storage portion 32. In this case, the pressure control portion 36 can control an adjustment operation of the pressure adjustment portion 12 based on the setting information stored in the storage portion 32.

In addition, the tension control portion 37 controls the tension of the upper thread UT to have a value corresponding to the computed difference. For example, the tension control portion 37 adjusts the thread adjuster so that the greater the difference between the feeding amount of the feeding belts 21A and the feeding amount of the feeding belts 21B, the less the tension of the upper thread UT.

FIG. 5 is a diagram showing an example of a relationship between a difference in a feeding amount of feeding belts 21 and a tension of an upper thread UT. FIG. 5 shows an example that the feeding amount of the feeding belts 21A is constant (for example, the feeding amount per unit time is 3 mm) and the feeding amount of the feeding belts 21B changes. As shown in FIG. 5, the tension of the upper thread UT is increased as the difference between the feeding amount of the feeding belts 21A and the feeding amount of the feeding belts 21B increases. Setting information shown in FIG. 5 can be stored, for example, in the storage portion 32. In this case, the tension control portion 37 can control the adjustment operation of the pressure adjustment portion 12 based on the setting information stored in the storage portion 32.

As described above, the sewing machine 1 of this embodiment includes: the sewing needle 3, where the sewing needing 3 is held by the needle bar 4, and the sewing needing 3 moves back and forth while holding the upper thread: the shuttle 9, where the shuttle 9 is configured to hold the bobbin around which the lower thread is wound and which is housed in the bobbin case, and the shuttle 9 cooperates with the sewing needle 3 to form the seam SE; the presser foot member 8, configured to press the to-be-sewn article S at the sewing position PS directly below the sewing needle 3: the pressure adjustment portion 12, adjusting the pressure of the presser foot member 8 on the to-be-sewn article S; the feeding mechanism 11, where endless feeding belts 21 for feeding the to-be-sewn article S from the sewing position PS to the Y-axis direction are disposed on two sides of the X-axis direction orthogonal to the Y-axis direction with respect to the sewing position PS, the feeding mechanism 11 is provided with the belt drive portion 22, and the belt drive portion 22 independently drives the feeding belts 21 on the +X side of the X-axis direction with respect to the sewing position PS and the feeding belts 21 on the −X side of the X-axis direction with respect to the sewing position PS is provided: and the control portion 30, configured to control the pressure adjustment portion 12 to make the pressure of the presser foot member 8 be corresponding to the difference between the feeding amount of the feeding belts 21 on +X side of the X-axis direction with respect to the sewing position PS and the feeding amount of the feeding belts 21 on the −X side of the X-axis direction with respect to the sewing position PS.

Based on this structure, since the pressure adjustment portion 12 is controlled to make the pressure of the presser foot member 8 be corresponding to the difference between the feeding amount of the feeding belts 21 on +X side of the X-axis direction with respect to the sewing position PS and the feeding amount of the feeding belts 21 on the −X side of the X-axis direction with respect to the sewing position PS, sewing defects when forming the seam SE on the to-be-sewn article S can be suppressed.

In the sewing machine 1 of the embodiment, the control portion 30 controls the pressure adjustment portion 12 so that the greater the difference between the feeding amount of the feeding belts 21 on −X side of the X-axis direction with respect to the sewing position PS and the feeding amount of the feeding belts 21 on the +X side of the X-axis direction with respect to the sewing position PS, the less the pressure of the presser foot member 8. According to this structure, the sewing defects when forming the seam SE on the to-be-sewn article S can be more reliably suppressed.

In the sewing machine 1 of the embodiment, the feeding mechanism 11 is provided at least below the to-be-sewn article S provided at the sewing position PS. Based on this structure, the to-be-sewn article S can be fed appropriately.

In the sewing machine 1 of the embodiment, the feeding mechanism 11 includes a plurality of the feeding belts 21 on the −X side with respect to the sewing position PS and the +X side with respect to the sewing position PS. According to this structure, the to-be-sewn article S can be fed appropriately.

The sewing machine 1 of the embodiment further includes the thread adjuster 6 that adjusts the tension of the upper thread. The control portion 30 controls the thread adjuster 6 to make the greater the difference between the feeding amount of the feeding belts 21 on −X side of the X-axis direction with respect to the sewing position PS and the feeding amount of the feeding belts 21 on the +X side of the X-axis direction with respect to the sewing position PS, the greater the tension of the upper thread. Based on this structure, a high-quality seam SE can be formed on the to-be-sewn article S.

The scope of the present disclosure is not limited to the above-mentioned embodiments, and can be appropriately modified within the scope that does not deviate from the essence of the present disclosure.

What is claimed is:

1. A sewing machine, comprising:

a sewing needle, held by a needle bar, and moving back and forth while holding an upper thread;

a shuttle, configured to hold a bobbin around which a lower thread is wound and which is housed in a bobbin case, and cooperating with the sewing needle to form a seam;

a presser foot member, configured to press a to-be-sewn article at a sewing position directly below the sewing needle;

a pressure adjustment portion, adjusting pressure applied to the to-be-sewn article by the presser foot member;

a feeding mechanism, wherein endless feeding belts for feeding the to-be-sewn article from the sewing position to a first direction are disposed on two sides of a second direction orthogonal to a first direction with respect to the sewing position, the feeding mechanism is provided with a belt drive portion, and the belt drive portion independently drives the feeding belts on one side of the second direction with respect to the sewing position and the feeding belts on another side of the second direction with respect to the sewing position; and a control portion, configured to control the pressure adjustment portion to make a pressure of the presser foot member be corresponding to a difference between a feeding amount of the feeding belts on one side of the second direction with respect to the sewing position and a feeding amount of the feeding belts on another side of the second direction with respect to the sewing position.

2. The sewing machine of claim 1, wherein the control portion controls the pressure adjustment portion to make the greater the difference between the feeding amount of the feeding belts on the one side of the second direction with respect to the sewing position and the feeding amount of the feeding belts on the another side of the second direction with respect to the sewing position, the less the pressure of the presser foot member.

3. The sewing machine of claim 1, wherein the feeding mechanism is provided at least below the to-be-sewn article provided at the sewing position.

4. The sewing machine of claim 1, wherein the feeding mechanism comprises a plurality of the feeding belts on one side with respect to the sewing position and another side with respect to the sewing position.

5. The sewing machine of claim 1, further comprising:

an upper thread tension adjustment mechanism, adjusting a tension of the upper thread, wherein the control portion controls the upper thread tension adjustment mechanism to make the greater the difference between the feeding amount of the feeding belts on the one side of the second direction with respect to the sewing position and the feeding amount of the feeding belts on the another side of the second direction with respect to the sewing position, the greater the tension of the upper thread.

* * * * *